United States Patent [19]

Dagenais et al.

[11] Patent Number: 4,633,652

[45] Date of Patent: Jan. 6, 1987

[54] METHOD AND APPARATUS FOR AUTOMATICALLY PACKING SAUSAGE LINKS

[75] Inventors: Georges Dagenais, Montréal; Ghislain Michaud, Laval; Michel Presseau, St.-Francois de Laval, all of Canada

[73] Assignee: Les Epiciers Unis Metro-Richelieu Inc., Montréal, Canada

[21] Appl. No.: 826,000

[22] Filed: Feb. 4, 1986

[51] Int. Cl.[4] ..... B65B 19/34; B65B 19/10

[52] U.S. Cl. ..... 53/444; 53/448; 53/148; 53/152; 53/501

[58] Field of Search ..... 53/152, 153, 148, 251, 53/501, 500, 448, 444, 247, 531

[56] References Cited

U.S. PATENT DOCUMENTS

| | | | |
|---|---|---|---|
| 1,659,831 | 2/1928 | Mudd | 53/152 X |
| 1,821,111 | 9/1931 | Mudd | 53/152 X |
| 2,948,093 | 8/1960 | Bonami | 53/148 X |
| 3,445,986 | 5/1969 | Godet | 53/148 |
| 3,655,180 | 4/1972 | Holler | 53/540 X |
| 3,954,165 | 5/1976 | Snyder | 53/152 X |
| 4,344,523 | 8/1982 | May et al. | 53/251 X |

*Primary Examiner*—Horace M. Culver

*Attorney, Agent, or Firm*—Oblon, Fisher, Spivak, McClelland, & Maier

[57] ABSTRACT

Method and apparatus for automatically packing sausage links in containers. A high speed feed conveyor feeds a plurality of spaced apart sausage links, in a lengthwise orientation, to a further conveyor having a plurality of transverse compartments. A sausage link is received in each compartment and their arc conveyed transversewise, in side-by-side relationship, to a group forming station. Sensing devices are provided to determine when a predetermined quantity of sausage links are at the forming station. A movable platform then displaces the sausage links from the group forming station to an unloading station where they are reoriented in side-by-side contact relationship and unloaded into a container by a pusher mechanism. While the group of sausage links is being unloaded, another group is being formed at the forming station.

20 Claims, 8 Drawing Figures

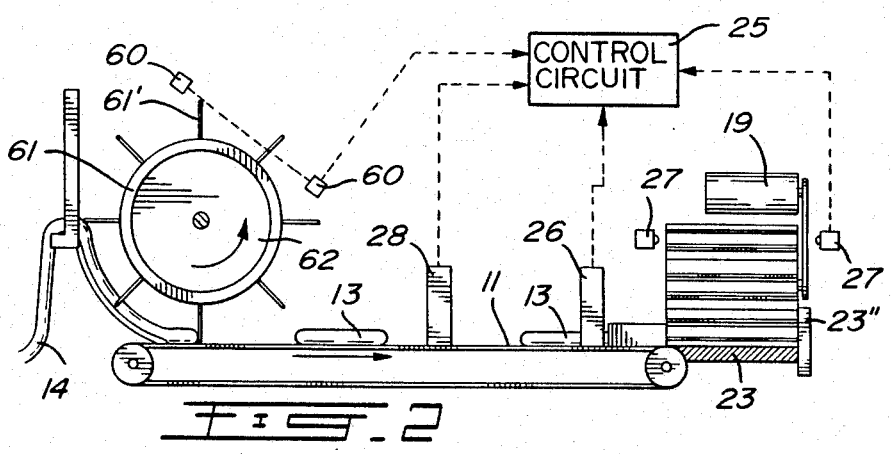
FIG. 2
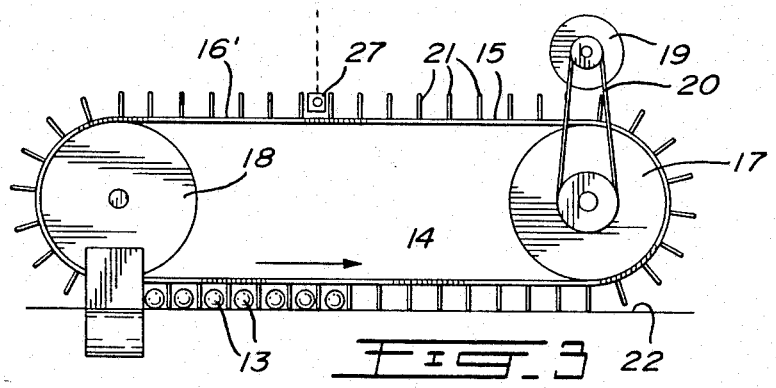
FIG. 3
FIG. 4
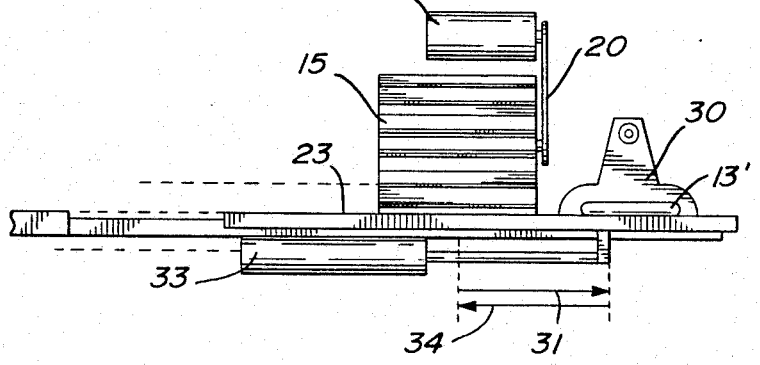

METHOD AND APPARATUS FOR AUTOMATICALLY PACKING SAUSAGE LINKS

BACKGROUND OF INVENTION

1. Field of Invention

The present invention relates to a method and an apparatus for automatically packing sausage links in containers and particularly the handling, grouping, and packing of soft deformable sausage links at high speed.

2. Description of Prior Art

Various types of sorting, orienting and packing machines are known in the art to pack elongated tubular-like articles into specific type containers. For example, cigarette packing machines effect such manipulations. U.S. Pat. No. 2,948,093 issued to Bonami on Aug. 9, 1960 discloses a method and apparatus for assembling cylindrical objects, such as frankfurters. However, most of the art known deals with handling of objects having substantial rigidity along their long axis and are unsuitable for handling soft deformable rod-like articles such as sausage links having fresh uncooked meat therein.

Presently, these type sausage links are being packaged manually and this involves a time consuming labor intensive process. The sausage links must be counted manually and disposed within a container manually with a specific number of sausage links in each row. Usually these containers contain 8 rows of eighteen sausage links. A disadvantage with the counting and handling of these sausage links manually is that it is a time consuming operation; it requires precise manual counting of the number of sausage links to be placed within the container; the sausage links are often damaged when manipulated by hand, particularly if the ends of the casing tube in which the meat is contained is slightly open; and is a costly and slow process due to the intensive labor requirement in order to achieve a reasonable production. Another disadvantage is that due to human handling, extra sanitary care must be taken when manipulating the meat as it is exposed to human environment capable of carrying bacteria

SUMMARY OF INVENTION

It is a feature of the present invention to provide a method and an apparatus for automatically packing sausage links which substantially overcomes all of the above disadvantages of the prior art.

According to the above feature, from a broad aspect, the present invention provides an automatic sausage link packing machine comprising a feed conveyor means for feeding a plurality of spaced apart sausage links in a lengthwise direction. Compartment conveying means is provided for receiving the sausage links in individual compartments and conveying them transversewise in side-by-side relationship to a group forming station. Sensing means is provided to determine a predetermined quantity of the sausage links at the group forming station to form a predetermined group of sausage links. Unloading means is provided for orienting the formed group of sausage links, in side-by-side contact relationship and unloading them into a container. Control means is provided to permit the feed conveyor means and the compartment conveying means to position a second group of sausage links at the group forming station during the operation cycle of the unloading means.

According to a further broad aspect of the present invention there is provided a method for automatically packing sausage links in a container, which method comprises the steps of feeding individual links of sausages at a high speed into a respective compartment of compartment conveying means. The compartments and associated sausage links are displaced transversewise with the sausages oriented in side-by-side relationship. Sausage links are counted and fed to the compartments to determine a predetermined quantity thereof at a group forming station. The predetermined quantity of sausage links at the group forming station are then displaced to an unloading station where they are oriented in side-by-side contact relationship and unloaded within a container while a second group of sausage links is being formed at the group forming station.

BRIEF DESCRIPTION OF DRAWINGS

A preferred embodiment of the present invention will now be described with reference to the example thereof which is illustrated in the accompanying drawings in which:

FIG. 2 is a schematic side view of the input feed conveyor;

FIG. 3 is a simplified schematic side view of the compartment belt conveyor;

FIG. 4 is an end view of FIG. 3;

DESCRIPTION OF PREFERRED EMBODIMENTS

Figure 1:
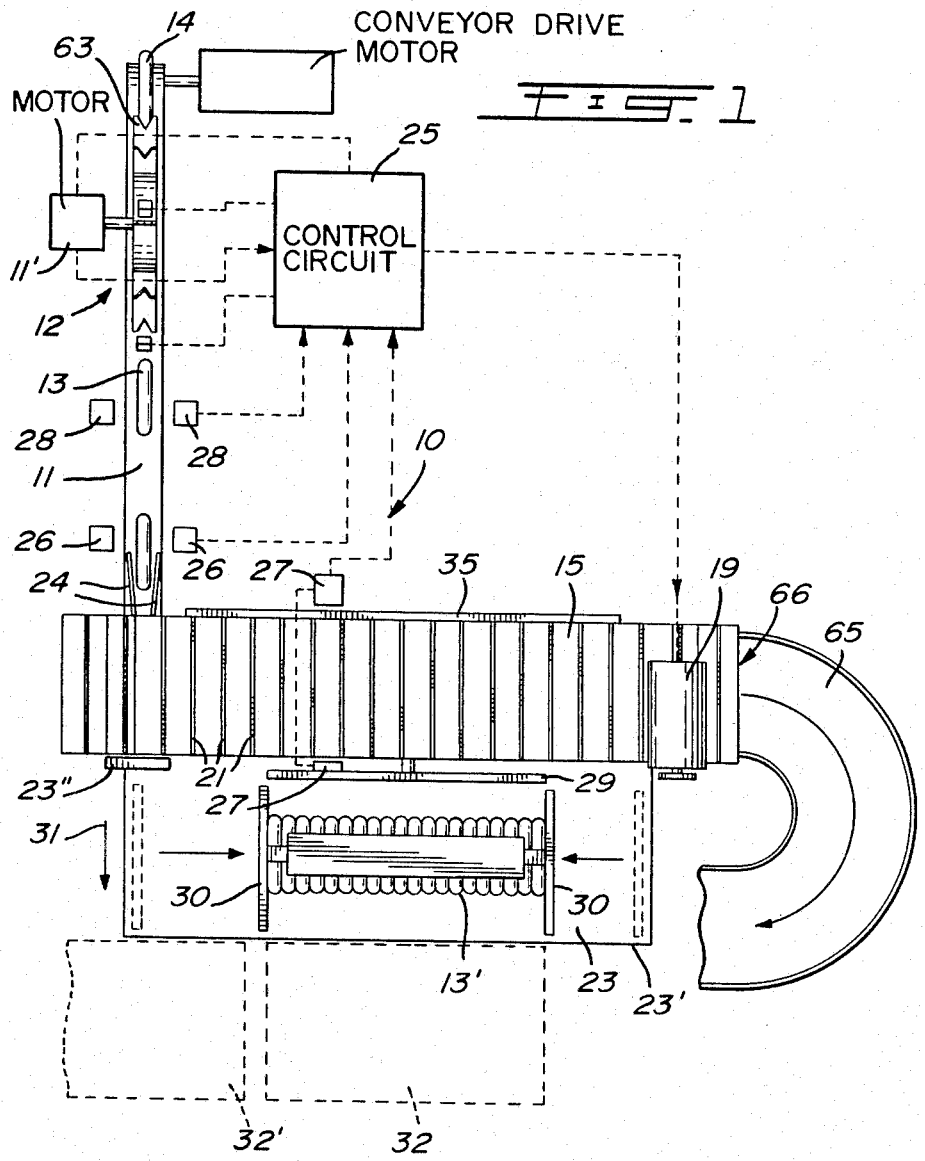
FIG. 1 is a simplified plan view of the automatic sausage link packing machine of the present invention.

Referring now to the drawings, and more particularly to FIGS. 1 to 3, there is shown generally at 10 the automatic sausage link packing machine of the present invention. The machine comprises a high speed feed conveyor 11, herein shown as a narrow endless belt, having a receiving end disposed at a link forming station 12 where sausage links 13 are cut from an endless sausage tube 14 and disposed onto the conveyor where they are fed at high speed into individual compartments 14 of a compartment conveyor 15.

The compartment conveyor 15 is better illustrated in FIG. 3 and consists of an endless belt 16 supported about a drive cylinder 17 and an idle cylinder 18. The cylinder 17 is driven by a step motor 19 which is connected thereto by suitable linkage means such as a timing drive belt 20. The endless belt 16 is provided with a plurality of equidistantly spaced transverse compartment forming walls 21 secured to an outer surface 16' of the endless belt 16 with the walls forming a row of elongated displaceable open-ended compartments 14 when displaced over the top flat surface 22 of a movable platform 23. As herein shown, the endless belt 16 has a straight-run section disposed extending parallel above the top flat surface 22 to define four walls having open ends to constitute the compartments into which sausage links are disposed.

As shown in FIG. 1, the feed conveyor 11 is disposed in alignment with a receiving end of the compartment conveyor 15. A stationary stop plate 23" is disposed adjacent the conveyor 15, at the receiving end, whereby to block an outer end of the compartments displaced at the receiving end whereby to stop the travel of the sausage links 13 which are fed at high speed within the receiving compartment. The sausage links are guided at the point of entry into a compartment by guide plates 24. When the sausages are severed at the link forming station, often these sausage links have an irregular formed end, due to the meat product therein, and as soon as the front end of the sausage link hits the stop plate 23, that end is squared off and the meat is slightly compacted back into the casing tube of the sausage link.

A control circuit 25 is provided to permit synchronism of the automatic sausage link packing machine. The feed conveyor 11 runs continuously and is driven by motor 11' which is provided with a brake and clutch (not shown) and controlled by the control circuit 25. Photocell 26 detects the presence of a sausage link 13 at the entry position of the receiving compartment in line with conveyor 15 and sends a signal to the step motor 19 to momentarily start the conveyor 15 to position another compartment at the receiving end in order to accept a sausage link therein. A further photocell 27 is provided to detect adjacent ones of the compartment forming walls 21 whereby to control the operation of the motor to displace one compartment at a time. The signals from photocell 26 are also counted in the control circuit 25 whereby to activate an unloading mechanism which comprises the movable platform 23, the pusher plate 29, and the compacting plates 30 operating in synchronism.

A photocell 28 constitutes a third detector device, which detects the distance between the sausage links 13 being displaced lengthwise by the belt conveyor 11. The photocell 28 is also connected to the control circuit 25 to stop the cutter wheel 61 upon detection of a predetermined minimum spacing between the sausage links. If the links are too close, then there is insufficient time for the compartments to be advanced. After rectification, the control circuit is given a signal to release the brake and engage the clutch (not shown) of the motor 11.

Figure 5:
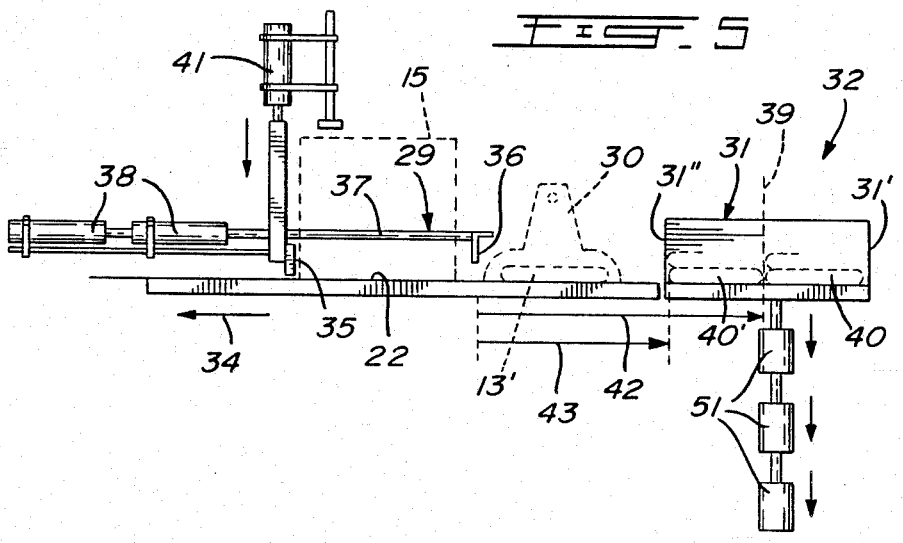
FIG. 5 is a simplified schematic view illustrating the unloading mechanism.

As shown in FIGS. 1, 4, and 5, the movable platform 23 is a rectangular plate having a flat top surface 22 formed of a material suitable for sliding displacement of sausages thereover, such as nylon, or other suitable type plastics material preventing the sausage casings from sticking thereon. As shown in these Figures, the plate is in its unloading position where a predetermined group of sausage tubes, namely eighteen sausage links 13 in predetermined compartments 14, between the drive sprocket 17 and idle sprocket 18, has been moved forwardly by the displacement of the platform 23 in the direction of arrow 34'. Once the sausage links are moved outwardly, they are spaced apart from one another due to the widths of the compartments 14 being larger than the diameter of the sausages, and it is now necessary to reorient the sausages into a side-by-side contact relationship. This is effected by firstly moving the pair of lateral compacting guide plates 30 toward each other, a predetermined distance, whereby the sausage links are brought in substantially side-by-side contact relationship. Thereafter, the group of sausages, as shown at 13', are displaced by the pusher plate 29 from the unloading station, as shown in FIG. 1, into a waxed cardboard box or container 31 which is maintained open at a receiving station 32.

The movable platform 23 is operated by an air cylinder 33 and after the group of sausages 13' has been positioned within the box or container 31, the platform 23 is retracted back to a pick-up position in the direction as indicated by arrow 34. This rearward movement of the platform 23 pushes the sausage links 13 which are resting thereon and disposed in the compartments 14, rearwardly where they abut against an elongated alignment wall 35 where the sausage links are arrested. This wall 35 aligns the links in side-by-side relationship, and further compacts the ends of the sausage links much like the opposite end was compacted when it hit the stop plate 23" at the receiving end of the compartment conveyor 15. As soon as the platform 23 reaches its maximum rearward travel, there is now a predetermined number of sausage links, herein eighteen, at the group forming station and the plaform is again moved to a discharge position in the direction of arrow 34' where the next group is discharged in the container 31. Thus, as a group of sausage links is discharged, another group is being gathered at the forming station.

Referring to FIG. 5, there is shown the construction of a pusher plate 29 and it comprises essentially a flat vertical plate 36 secured at the end of a boom or cylinder rod 37 which is in turn activated by a cylinder 38 for moving the plate 36 to a first loading position where the plate 36 advances to position 39 to load a first row 40 of sausage links adjacent the back wall 31' of the container 31 and in a subsequent stroke moves to a position which is in line with the forward open end 31" of the container 31 with a second row of sausage links 40' disposed in front of the first row 40. Before the pusher plate 29 is retracted, it is lifted, together with its piston 38 and support, to its position as shown in FIG. 5 by the cylinder 41, which displaces a displaceable frame 41', whereby to permit the group of sausage links at the group forming station to be displaced forwardly thereunder to the unloading position, as shown at 13'. The travel of the first and second stroke is identified by the length of arrow lines 42 and 43 respectively.

Figure 8:
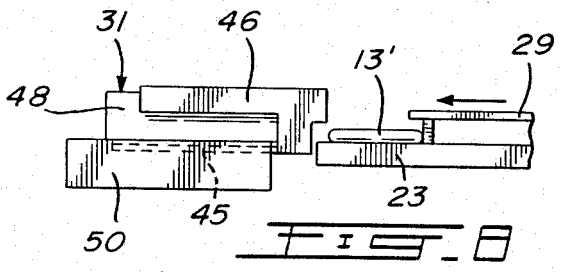
FIG. 8 is an end view showing the box container positioned at a sausage link receiving station and being loaded with a group of sausage links.
Figure 6:
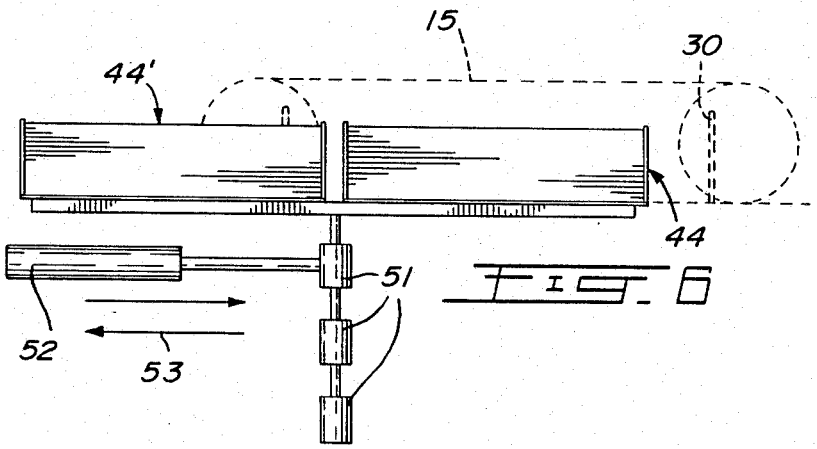
FIG. 6 is a simplified schematic end view showing two containers secured to container holders.
Figure 7:
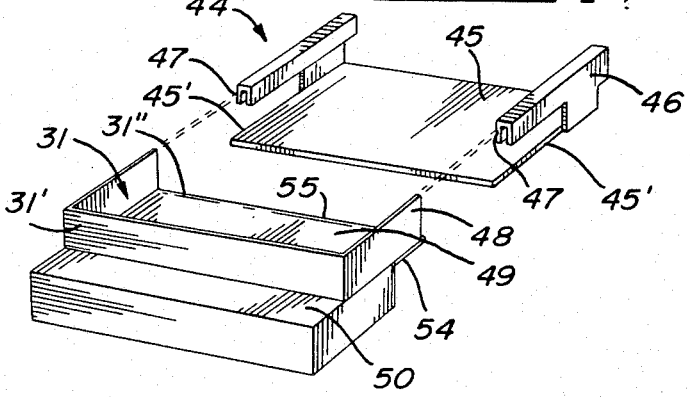
FIG. 7 is a perspective view showing a container holder and the configuration of the box container and its securement to the holder.

Referring now additionally to FIGS. 6 to 8, there is shown the construction of holding means 44 which is disposed at the receiving station 32 and 32', see FIG. 1, whereby to retain a box or container 31 in a sausage link receiving or packing position. As better illustrated in FIG. 7, the holding means comprises a flat support base 45 having an elevated container side wall holding bracket 46 supported above adjacent side edges 45' of the base. The bracket 46 has a U-shaped box-retaining channel 47 in a top portion thereof whereby to receive a top portion of the end panels 48 of the container 31 therein. The bottom wall 49 of the box, as well as a portion of the cover 50, which is folded in juxtaposition under the bottom wall 49 are received on top of the support base 45 with the top surface of the bottom wall being aligned substantially in the same plane as the top surface 22 of the movable platform 23. The spacing between the base 45 and the bottom of the channels 47 holds the bottom wall 49 of the box firmly in position.

After two rows of sausage links have been positioned over the bottom wall 49, as shown at 40 and 40' in FIG. 5, an automatic displacement means in the form of a three-stroke piston 51 displaces the container holding means 44 downwardly a distance approximately equal to the thickness of the sausage links whereby further rows of sausage links may be positioned over the bottom rows. Preferably, a wax paper or other suitable paper sheet, having a slippery surface, is positioned over the bottom rows of sausage links to facilitate loading and to further facilitate later separating the sausage links by preventing the row to stick together, particularly if the sausage links are frozen. After the second row has been positioned in the box, the container holder is then brought down to a third position where the third row is formed. Thereafter, a piston 52 is activated whereby to move a further container holder 44, also supporting a box, to the loading position 32 as shown in FIG. 1. While the container 44' is being loaded, another carton is engaged with the holder 44. Thereafter the piston 52 retracts the holder 44, in the direction of arrow 53 and back to its initial position. While the container engaged by the holder 44 is being filled, the container 31 which has been filled is removed from the holder 44 and the cover 50 is hinged back onto the open top end whereby to seal the box. The front wall flat 54 of the carton seals the loading opening 31'' of the box. As shown, this flap 54 does not have a side wall whereby to permit the front edge 55 of the carton to be disposed adjacent the front edge 23' of the movable platform 23.

Referring to FIG. 2, there is shown the provision of further photodetectors 60 which are disposed in alignment with scissor-like cutting elements 61 which are supported at spaced apart intervals along the periphery of a cutting wheel 62. These photodetectors 60 are aligned whereby to detect if the scissor-like cutting elements 61 have properly operated. If the cutting elements 61 have not returned to their initial open position, the cutting wheel 62 is stopped and no further sausage links are conveyed.

As shown in FIG. 1 there is also provided a chute 65 disposed adjacent the exit end 66 of the compartment conveyor 15 whereby to discharge all sausage links engaged in the compartment should it be necessary to clear the machine if there was a malfunction or links missing in the compartments or at the end of operation of the machine.

Summarizing the operation of the high speed automatic sausage packing machine 10, an endless meat casing 14 is fed to a link forming station 12 where the casing is cut into sausage links which are then fed to a compartment conveyor 15 by means of a high speed feed conveyor 11. The conveyor 15 orients a group of sausages in side-by-side relationship at a group forming station. The machine as herein represented can position eighteen sausage links in three seconds at the group forming station. This group of sausages is then displaced by the movable platform 23 to an unloading station in a time frame of about half a second. It takes about three seconds for the unloading mechanism to place the group of sausage links in a container 31 and return the mechanism to its original position ready to push the second group of sausage links. As the sausage links are loaded in a container, the container is displaced and once filled, a new container is positioned at a loading station.

It is within the ambit of the present invention to cover any obvious modifications of the example of the preferred embodiment as described herein, provided such modifications fall within the scope of the appended claims.

We claim:

1. An automatic sausage link packing machine comprising a feed conveyor means for feeding a plurality of spaced-apart sausage links in a lengthwise direction, compartment conveying means for receiving said sausage links in individual compartments and conveying them transversewise in side-by-side relationship to a grpup forming station, sensing means to determined a predetermined quantity of said sausage links at said group forming station to form a predetermined group of sausage links, unloading means for orienting said group of sausage links in substantially side-by-side contact relationship and unloading them into a container, and control means to permit said feed conveyor means and said compartment conveying means to position a second group of sausage links at said group forming station during the operation cycle of said unloading means.

2. A sausage link packing machine as claimed in claim 1 wherein said unloading means comprises a movable platform on which said sausage links are displaced by said compartment conveying means, said platform being displaceable on an axis coextensive with the lengthwise orientation of said group of sausage links at said group forming station, and means to compact said group of sausage links at an unloading station on said platform to place them in said side-by-side contact relationship, and discharge means to displace said sausage links from said unloading station to said container.

3. A sausage link packing machine as claimed in claim 2 wherein said means to compact said group of sausage links comprises a pair of lateral compacting plates, each plate being positioned on a respective side of said group of sausage links at said unloading station, and means to displace said compacting plates a predetermined distance toward one another to orient said sausage links in side-by-side contact relationship.

4. A sausage link packing machine as claimed in claim 3 wherein said discharge means is a pusher plate for displacing said group of sausage links from said unloading station into said container.

5. A sausage link packing machine as claimed in claim 4 wherein said pusher plate is secured to a displaceable frame connected to a first piston rod to move said pusher plate along a vertical axis to orient said pusher plate behind said group of sausage links for pushing contact therewith, and a second piston connected to said displaceable frame to move said pusher plate along a horizontal axis to displace said pusher plate between said compacting guide plates to move said group of sausage links into said container.

6. A sausage link packing machine as claimed in claim 2 wherein said compartment conveying means comprises an endless belt conveyor having a straight-run section disposed spaced above a top flat surface of said movable platform, a plurality of transverse compartment forming walls are secured equidistantly spaced apart on an outer surface of said endless belt whereby said walls form a row of elongated displaceable open ended tubular compartments when displaced above said top flat surface of said movable platform.

7. A sausage link packing machine as claimed in claim 6 wherein said conveyor means is aligned with a receiving end of said row of compartments, and a stationary stop plate disposed adjacent an outer end of said displaceable tubular compartments at said receiving end to stop the travel of said sausage links fed lengthwise by said conveyor means to orient said sausage links in individual ones of said rows of compartments.

8. A sausage link packing machine as claimed in claim 7 wherein there is further provided an elongated alignment wall secured stationary adjacent an open end of said compartments displaced along said group forming station on a side of said endless belt conveyor opposite said side adjacent said unloading station, said alignment wall being disposed slightly above said movable platform.

9. A sausage link packing machine as claimed in claim 7 wherein said conveyor means is a belt conveyor having guide plates to direct said sausages in said individual compartments.

10. A sausage link packing machine as claimed in claim 2 wherein said sensing means comprises a first detector device for detecting and counting sausage links fed by said conveyor means to said compartment conveying means, a second detector device for sensing the position of individual ones of said compartments displaced in relation therewith, said compartment conveying means being an endless belt conveyor driven by a step motor, said step motor being controlled by control circuit means synchronized to said detectors.

11. A sausage link packing machine as claimed in claim 10 wherein there is further provided a third detector device secured at a predetermined position adjacent said conveyor means whereby to detect the distance between sausage links fed lengthwise on said conveyor means, said third detector device being connected to said control circuit means to stop a cutter wheel feeding said links to said feed conveyor upon detection of a predetermined minimum spacing between said sausage links fed lengthwise.

12. A sausage link packing machine as claimed in claim 2 wherein there is further provided detecting means to detect the condition of cutting elements associated with a sausage link forming device depositing sausage links onto said conveyor means.

13. A sausage link packing machine as claimed in claim 11 wherein said first, second and third detector devices are photoelectric cells.

14. A sausage link packing machine as claimed in claim 2 wherein there is further provided container holding means for holding a container in an open link-receiving condition to permit said group of sausage links at said unloading station to be pushed into said container from an open side wall thereof.

15. A sausage link packing machine as claimed in claim 14 wherein said container holding means comprises a flat support base having an elevated container side wall holding bracket supported above adjacent side edges thereof, said container having a bottom wall supported on said support base and having an open ended loading wall and an end wall, said open ended loading wall facing said unloading station.

16. A sausage link packing machine as claimed in claim 15 wherein said flat support base is secured to automatic displacement means whereby to lower said base to a second level upon detection of a predetermined movement of said discharge means.

17. A sausage link packing machine as claimed in claim 16 wherein there is provided two flat support bases secured in a spaced apart side-by-side relationship and having their support base extending in a common horizontal plane, both said support bases being secured to said displacement means whereby said bases are displaced alternately to a sausage link receiving station adjacent said unloading station after its associated container is filled with groups of sausage links.

18. A method for automatically packing sausage links in a container comprising the steps of:

(i) feeding individual links of sausages at a high speed into a respective compartment of compartment conveying means;

(ii) displacing said compartments and associated sausage links transversewise with said sausages oriented in side-by-side relationship;

(iii) counting said sausage links fed to said compartments to determine a predetermined quantity thereof at a group forming station;

(iv) displacing said predetermined quantity of sausage links from said group forming station to an unloading station; and (v) orienting said group of sausage links in side-by-side contact relationship and unloading them in a container while a second group of sausage links is being formed at said group forming station.

19. A method as claimed in claim 18 wherein there is further provided the steps of:

(vi) supporting said container at a receiving station;

(vii) detecting the operation of said unloading step; and (viii) lowering the level of said container to a predetermined level upon detection of a predetermined operating cycle of a pusher plate effecting said unloading.

20. A method as claimed in claim 19 wherein there is further provided the step of:

(ix) displacing said container away from said receiving station and placing a second container at said receiving station.

* * * * *